United States Patent [19]

Farrow et al.

[11] Patent Number: 4,781,120

[45] Date of Patent: Nov. 1, 1988

[54] MONORAIL TRAIN SET

[76] Inventors: David A. Farrow, 1060 SW. 19th St., Boca Raton, Fla. 33432; George M. Kinley, III, 4554 Sunrise Blvd., Delray Beach, Fla. 33445; Michael A. Sandler, 836 NE. 76th St., Boca Raton, Fla. 33432

[21] Appl. No.: 3,270

[22] Filed: Jan. 14, 1987

[51] Int. Cl.[4] ..... A63H 19/36; A63H 19/28; A63H 19/30

[52] U.S. Cl. ..... 104/118; 238/10 A; 238/10 E; 238/DIG. 1; 446/75; 446/444; 105/1.5

[58] Field of Search ..... 238/10 R, 10 A, 10 E, 238/151; 104/118–120, 125, 126, 134, 69, DIG. 1; 105/1.5, 141, 144, 145; 252/56 R; 585/9; 446/75, 901, 467, 444; 217/62; 220/345

[56] References Cited

U.S. PATENT DOCUMENTS

| | | | |
|---|---|---|---|
| 180,400 | 7/1876 | Westcott | 104/134 X |
| 1,603,393 | 10/1926 | Malcolm | 104/134 X |
| 2,955,763 | 10/1960 | Shapin | 238/10 A |
| 2,960,216 | 11/1960 | Brady | 220/345 X |
| 3,338,175 | 8/1967 | Hardy et al. | 104/134 X |
| 3,562,950 | 2/1971 | Genin | 238/10 E X |
| 3,603,505 | 9/1971 | Tsugawa | 238/10 A X |
| 3,767,460 | 10/1973 | Kennel et al. | 585/9 X |
| 4,515,360 | 5/1985 | Mariol | 220/351 X |
| 4,632,038 | 12/1986 | Lawrence | 105/141 X |
| 4,669,657 | 6/1987 | Crain et al. | 446/75 X |

FOREIGN PATENT DOCUMENTS 2155978 10/1985 United Kingdom .

*Primary Examiner*—Robert B. Reeves
*Assistant Examiner*—Scott H. Werny
*Attorney, Agent, or Firm*—Harry W. Barron

[57] ABSTRACT

A toy monorail set is provided including a building for containing the parts to the set and selectively being a component part of the set. The monorail vehicle, building and monorail tracks are all made of sanded hardwood or other suitable smooth and hard material. The vehicle itself includes a cutout and a pair of extension members extending outward from the bottom of the cutout. The cutout has concave sides and the extension members have a flat surface and slanted sides from the back of the cutout to the flat surface so as to allow the vehicle to traverse a curved monorail track course. A smoothing additive, such as wax or paraffin is applied over the flat surface of the extension member and the top, or riding, surface of the monorail track to allow the vehicle to slide over the monorail track. The monorail tracks have semicircular ends with a circular recessed surface on opposite sides at each end. A compressive coupling pad is affixed on each recessed surface so that the monorail tracks may be coupled together. The containing building also includes a fixed monorail track and a plurality of openings to allow the building to be used as a part of the monorail track configuration. Further, the containing building has sliding panels which allow the parts of the set to be stored within the building when the set is not in use.

9 Claims, 2 Drawing Sheets

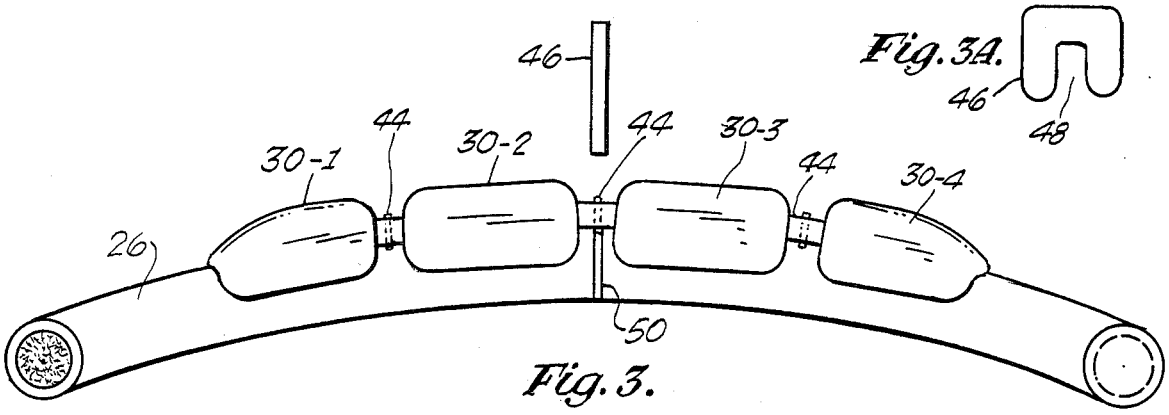
Fig. 3.
Fig. 3A.
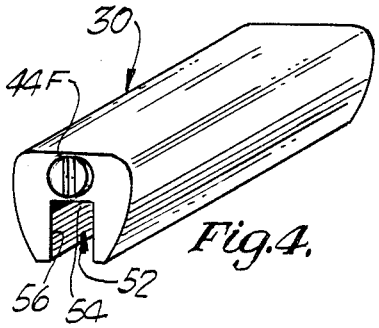
Fig. 4.
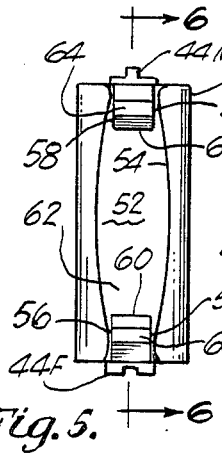
Fig. 5.
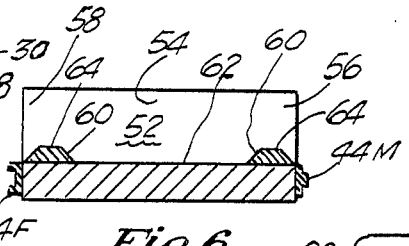
Fig. 6.
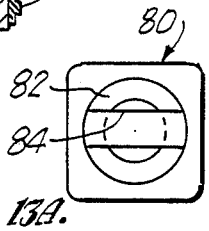
Fig. 13A.
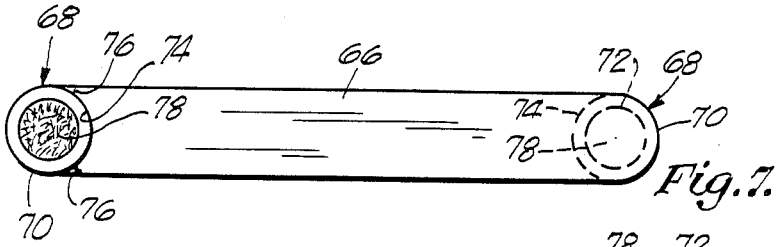
Fig. 7.
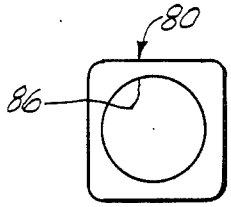
Fig. 13B.
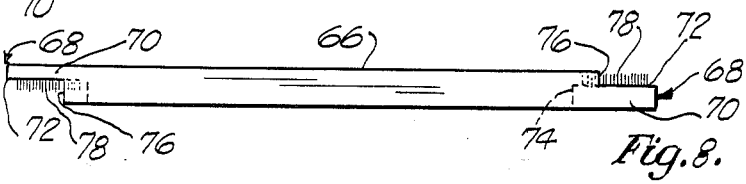
Fig. 8.
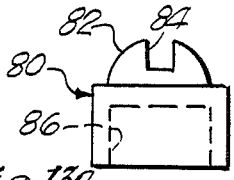
Fig. 13C.
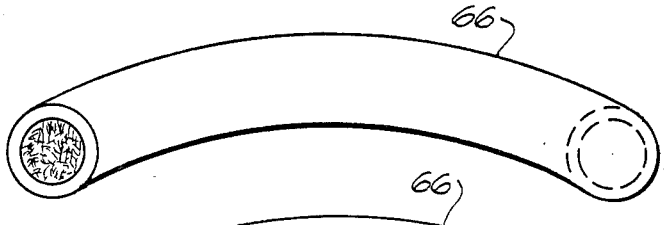
Fig. 9.
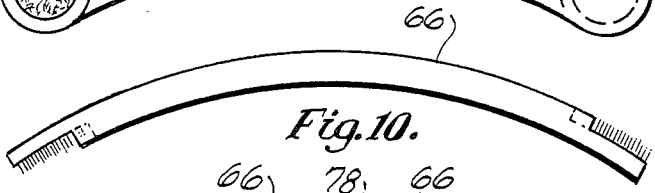
Fig. 10.
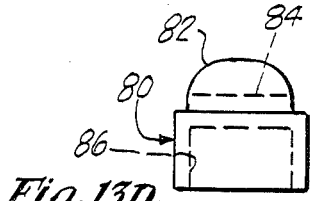
Fig. 13D.
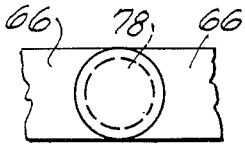
Fig. 11.
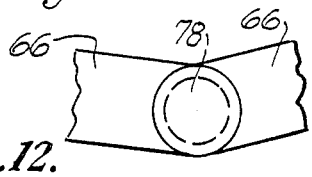
Fig. 12.

MONORAIL TRAIN SET

This invention relates to a toy monorail vehicle set, and more particularly, such a set having a slideable vehicle for use on monorail track components which easily and securely fit together and a building used for both storing the parts of the set and forming a part of the assembled set.

One of the most common and desirable toys for small children is a vehicle set in which a toy vehicle, such as a train or car, moves along a path defined by a track set. The movement may be caused either by the child pushing the vehicle or by an internal motor mechanism within the vehicle which can be actuated by the child. The vehicles used in such sets typically have wheels which are necessary to allow the vehicle to easily move. However, the wheels also tend to be the most easily broken part of the vehicle and when even one wheel becomes inoperative, an entire set may be rendered useless.

Many vehicle sets include a number of pieces which are assembled into a closed loop track, such as a circle, oval or figure eight shape. Typically, these sets include a container in which the various parts, such as the track pieces, vehicle or vehicles and track stanchions, or risers, are stored when the toy is not in use. However, the container is usually unused during the actual play time of the child and thus, only has a single function. Some sets may use the storage container as a part of the assembled set in order to give it an additional function, but the need to store the parts generally renders the container too large for a small child's toy. Further, the container, even when used, is not a critical component of the assembled set, but rather, is merely an ornament to be used in association with, as opposed to a part of, the assembled set. One of the reasons that the containers have not been used in the past as a key part of the assembled set is that the required storage of components makes it difficult to also use the container as a functional part of the assembled set. For example, the vehicles typically are contained in recessed portions, which take away from the functional use of the set.

Another problem with the toy vehicle sets of the prior art has been the complexity of assembling the track. Typically, such track sets have required an interlocking of a male and female end of the track. For small children, this can be difficult and frustrating and hence, the child does not enjoy playing with the set. One of the most interesting types of tracks is a monorail train. Children of early ages are familiar with monorail trains, for instance, because of the one used at Disney World. However, building a monorail train set that is able to withstand breakage when used by children and which is sturdy and easily assembled presents many problems.

In accordance with one aspect of this invention, there is provided a toy monorail system in which a vehicle is to be manually propelled along a monorail. The system includes a monorail having a smooth top surface of a hard material and a given width and a vehicle for sliding over the monorail. The vehicle has a cutout in the bottom thereof wider than the given width and a pair of members extending from the body of the vehicle into the cutout. Each of the extension members have a hard material flat surface of substantially the given width and coplanar with the corresponding flat smooth surface of the other of the extension members and at least one of the monorail surface or the flat surfaces of the extension members having a smoothing additive placed thereon to permit the flat surfaces of the vehicle to easily slide over the flat surface of the monorail.

In accordance with another aspect of this invention, there is provided an improved monorail member having a rectangular cross section and a given length bounded by two ends. The member has a pair of relatively longer sides and a narrower top and bottom and forms a monorail track which can be attached to a similar monorail track. The improvement in the monorail member includes the member ends being formed in a semicircular shape with a diameter equal to the length between the top and bottom and first and second recessed surfaces, each positioned on an opposite side and end of the member. Each of the recessed surfaces extend from the top to the bottom of the member and back from the end of the member and each recessed surface terminates with a back in the shape of a circular arc of less than 180° and having a diameter equal to the length between the top and bottom. The back extends from the recessed surface to the side of the member. Further, the improvement includes attachment means affixed to each of the recessed surfaces within the circle formed by the member ends and recessed surface back, the attachment means being of a type to be compressively attached to a corresponding attachment means affixed on another member to form an affixation therebetween.

In accordance with another aspect of this invention, there is provided a track vehicle set container and component including a curved floor above the bottom of the container having a permanently affixed vehicle track thereon. In addition the container includes a plurality of openings through the container, two of which are aligned with the permanently affixed track and a third of which is below the floor and a plurality of fixed and removable panels forming a closed volume above the floor and below the floor on both sides of the third opening for storing assembleable parts to the set. The parts are attached from one side of the permanently affixed track to the other side of the permanently affixed track and include sufficient parts to provide a track path through the third opening. Further, the container includes a vehicle and engageable lock means, selectively affixing the vehicle to the permanently affixed track when engaged therebetween and allowing the vehicle to travel over a path defined by the assembled parts when disengaged.

One preferred embodiment of the subject invention is hereafter disclosed, with specific reference being made to the following Figures, in which:

FIG. 3 is a more detailed view of the monorail within the carrier shown in FIG. 1, including the vehicles and means for attaching the vehicles during storage;

FIG. 3A is a side view of the attaching member for attaching the vehicles as shown in FIG. 3;

FIG. 4 is a prospective view of one of the vehicles used in the subject invention;

FIG. 5 is a bottom view of the vehicle shown in FIG. 4;

FIG. 6 is a cross sectional view across lines 6—6 of FIG. 5;

FIG. 7 is a side view of a straight monorail track which can be used as a part of the subject invention;

FIG. 8 is a top view of the monorail track shown in FIG. 7;

FIG. 9 is a side view of a vertically curving type of monorail track which can be used as a part of the subject invention;

FIG. 10 is a top view of a side to side curving type of monorail track which can be used as a part of the subject invention;

FIG. 11 is a diagram showing two straight monorail tracks coupled together in a straight connection; and FIG. 12 is a diagram showing two straight monorail tracks coupled together in an angled connection.

FIG. 13A shows a top view of a stanchion useful as a part of the subject invention;

FIG. 13B shows a bottom view of a stanchion useful as a part of the subject invention;

FIG. 13C shows a front view of a stanchion useful as a part of the subject invention;

FIG. 13D shows a side view of a stanchion useful as a part of the subject invention.

Figure 1:
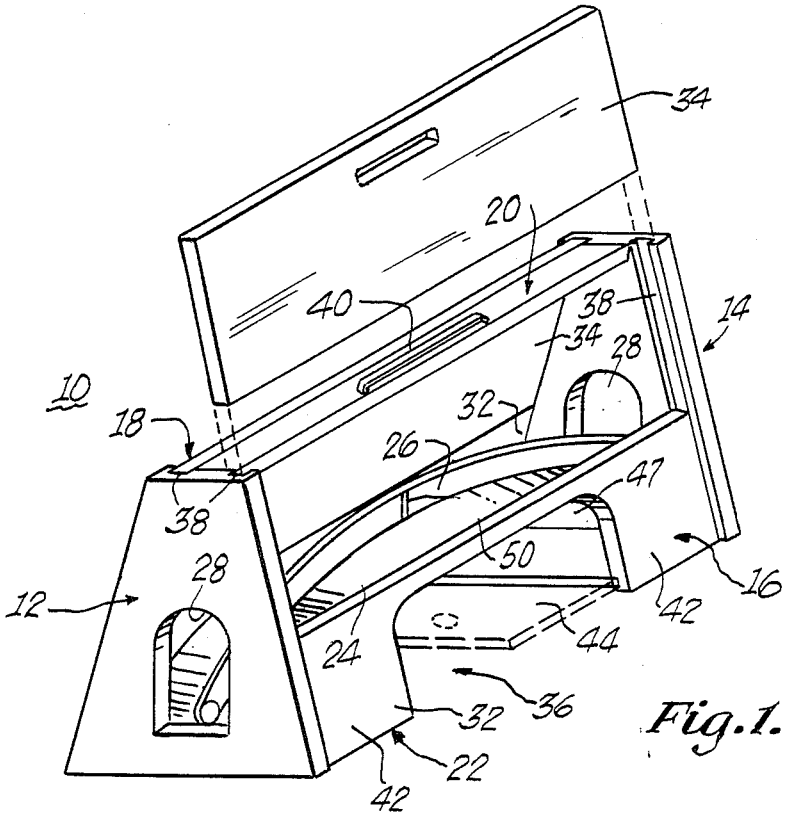
FIG. 1 is a prospective view of the carrier for the parts of the subject invention.
Figure 2:
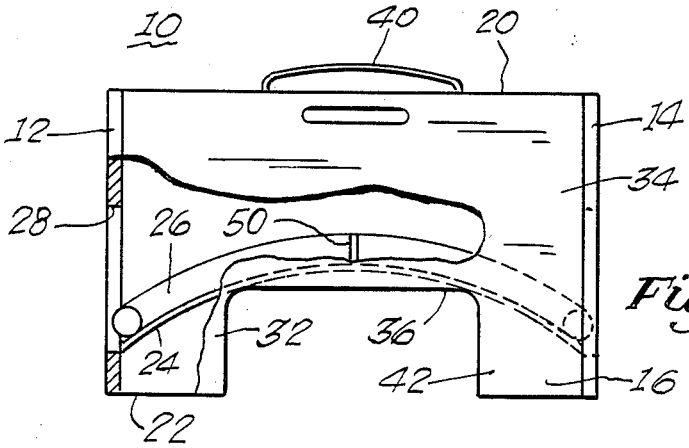
FIG. 2 is a side view, with a lower panel partially cutaway, of the carrier for the parts of the subject invention.
Figure 2A:
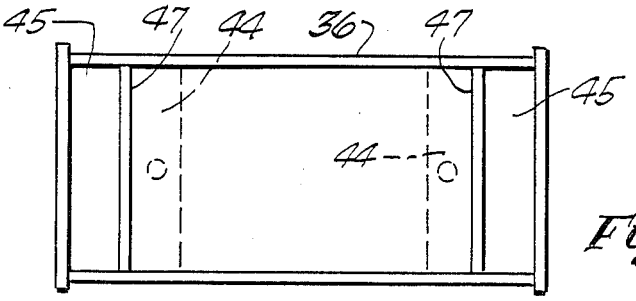
FIG. 2A is a bottom view of the carrier for the parts of the subject invention.

Referring now to FIGS. 1, 2 and 2A, carrier 10 is shown and is used as a storage case for the various parts of a monorail train set, as well as a component for the set. Carrier 10 includes identical front and back 12 and 14 and identical right and left sides 16 and 18, as well as a top 20 and a bottom 22. Front and back 12 and 14 are each shaped as an equilateral trapezoid and a curved floor 24, positioned between top 20 and bottom 22, connects front 12 and back 14. Floor 24 is curved in a concave manner, as viewed from bottom 22, between front 12 and back 14 and has a permanently mounted monorail track 26 affixed to the center thereof and extending from front 12 to back 14. An opening 28 is positioned in each of front 12 and back 14, with the bottom of opening 28 generally aligned with floor 24 at the position it intersects front 12 or back 14. The height of opening 28 is selected to be sufficient to allow a vehicle 30, such as shown in FIGS. 3–6, to pass through opening 28 when the vehicle 30 slides on monorail 26. Monorail track component 66, such as is described hereafter with respect to FIGS. 7 through 12, may be attached from the two ends of fixed monorail track 26 to form a closed loop track course, such as an oval or a FIG. 8 configuration.

The sides 16 and 18 of carrier 10 include a fixed panel 32 and a sliding panel 34. Fixed panel 32 is positioned generally from just above the peak of floor 24 to the bottom 22 of carrier 10. Within fixed panel 32 and positioned at the center and upwards from bottom 22 is an opening 36 of sufficient height and width to allow a monorail component 66 to be placed thereunder and a vehicle 30 to slide over the monorail. Thus, the track formed may be a FIG. 8 configuration through openings 36. The inside surfaces of front 12 and back 14 include grooves 38 for slidable holding sliding panel 34, such that when sliding panel 34 is held in each of the sides 16 and 18, a closed interior of container 10 is formed above floor 24. This closed interior is used to store the vehicle 30, as shown in FIG. 3, and the monorails components 66. When sliding panels 34 are removed, as shown in FIG. 1, the stored parts may be removed and assembled into a monorail configuration between the ends of monorail 26 affixed to floor 24 and forming either an oval or a FIG. 8 configuration through openings 36 in the fixed panels 32. The manner in which the monorail components 66 are coupled together or to the fixed monorail 26 will be described hereafter with respect to FIGS. 7 and 8.

The top 20 of carrier 10 extends from front 12 to back 14 and is of a width to extend between the two sliding panels 34 when inserted in the grooves 38. Positioned generally surrounding the center of top 20 is a handle 40 to permit carrier 10 to be easily transported when it is used to contain the monorail set parts. The bottom 22 of carrier 10 includes two generally identical legs 42 extending from below floor 24 and away from the opening 36. The bottom panel 44 below each of legs 42 slides into or out of position, as shown by the dashed lines in FIG. 1, to form a closed container 45 within each leg. Smaller parts, such as stanchions (shown in FIGS. 13A–13D) for holding the monorails above the ground, may be stored within container 45 in legs 42. As seen in FIG. 2A, container 45 is smaller than panel 44. The dimensions are selected so that the distance between the walls 47 forming container 45 is slightly greater than the track lengths, shown in FIGS. 7–10, so that the tracks can fit in the area between walls 47 and be held therein by the panels 44. Further, the opening 36 is made larger than the legs 42 so that the panels 44 can be removed after sliding out from the bottom of legs 42 to allow the stored track to be removed for use or inserted for storage.

Referring now to FIG. 3, the fixed monorail 26 is shown with a series of monorail vehicles 30-1, 30-2, 30-3 and 30-4 positioned thereon. Each of the monorail vehicles 30-1, 30-2, 30-3 and 30-4 are shown in more detail as vehicle 30 in FIGS. 4 through 6 and, as will be explained, are designed to slide over fixed monorail 26 or the monorail components 66, shown in FIGS. 7 through 10, coupled thereto. Each of the monorail vehicles 30-1, 30-2, 30-3 and 30-4 are connected together by a snap lock mechanism 44. The snap lock mechanisms 44 include a male and female portion 44M and 44F (shown in FIGS. 4 through 6) alternatively connected on adjacent vehicles 30-1, 30-2, 30-3 and 30-4 to allow a connection therebetween. Alternatively, a magnetic latch or a catch and loop coupling mechanism could be used.

When it is desired to secure the vehicles 30-1, 30-2, 30-3 and 30-4 for storage within carrier 10, a securing bracket 46 is used. The end view of securing bracket 46 is shown in FIG. 3 and the side view of securing bracket 46 is shown in FIG. 3A. Securing bracket 46 is thin enough to fit between adjacent vehicles 30-1, 30-2, 30-3 and 30-4 when coupled together by snap lock mechanism 44. An opening 48 in bracket 46 is adapted to fit around the snap lock mechanism 44 and slide into grooves 50 on both sides of fixed monorail 26. When bracket 46 is secured around lock mechanisms 44 into grooves 50, the coupled monorail vehicle 30-1, 30-2, 30-3 and 30-4 are held securely in place.

Referring now to FIGS. 4 through 6, monorail vehicle 30 is described. Vehicle 30 may be fabricated in any desired shape, although it is shown herein as generally blocked shaped. A cutout 52, or slot, is formed in the bottom of vehicle 30 and adapted to fit over the top and around the sides of fixed monorail 26 or monorail component 66. The sidewalls 54 of cutout 52 are slightly curved so that as vehicle 30 moves from side to side while sliding along the top of monorail 26, only the front 56 or back 58 of sides 54 will touch the sides of fixed monorail 26 or monorail component 66. The amount of the curve of sidewalls 54 may be selected to be the same as a monorail component 66 side to side curve, as shown in FIG. 10, so that the entire sidewall 54 does no contact the side surface of the monorail 26. Since vehicle 30 is designed to slide without any wheels over monorail 26, the surface area of the touching surfaces should be minimized.

A pair of extension members 60 of a trapezoidal shape, extend into cutout 52 from the body of vehicle 30, that is the extension members 60 are affixed to the bottom 62 of cutout 52, with the smaller side of the parallel surfaces of member 60 being the sliding surface 64. The spacing between members 60 and the distance between the parallel sliding surfaces should be selected to only allow the smaller surfaces to slide on the top of the monorail component 66 when the two monorail components 66 are connected together at an angle, as shown in FIG. 12, or when a vertically curving monorail component 66, such as shown in FIG. 9, is used. Alternatively, bottom 62 of cutout 52 may be fabricated as a curved surface and extension members 60 may be made of a shorter length.

Because vehicle 30 is designed to slide over the monorail 26 or 66, it is desirable that at least the sliding surface 64 of extension member 60 be a smooth, hard material, such as a sanded hardwood or a hard plastic. Further, the top side of monorails 26 and 66 should similarly be made of a smooth, hard material. Where the materials used are hardwood materials, a smoothing additive should be applied to the sliding surface 64 and the top of the monorails 26 and 66. A hard wax, or paraffin, may be applied to surface 64 to reduce the friction when vehicle 30 slides over the top surface of monorails 26 or 66. Further, the smoothing additive may be added to the front 56 and back 58 of cutout sides 54, since these surfaces will contact the sides of monorail 26. Similar smoothing additives should also be added to the top and side surfaces of monorails 26 and 66.

Referring now to FIGS. 7 through 10, the monorail component 66 is shown. As previously mentioned, the monorail component 66 may be a straight component, such as shown in FIG. 7 and 8, or the monorail component 66 may have a vertical curve, as shown in FIG. 9 or the monorail component 66 may have a side to side curve, as shown in FIG. 10. In any event, the basic coupling structure 68 on the ends of the various monorail components 66 is the same and only the straight component 66, shown in FIGS. 7 and 8, will be described in detail. The monorail components 66 may be fabricated entirely of hardwood material, or alternatively of hard plastic. The cross sectional size of each monorail component 66 may be nine sixteenths of an inch in width and one and nine sixteenths inches in height. Each of the two wider sides and narrower top and bottom should be rendered both hard and smooth. Where monorail component 66 is made of a hard wood material, the surfaces should be sanded smooth and a smoothing additive, such as wax, is applied.

The two ends 70 of monorail component 66 are semicircular shaped with a diameter equal to the height of monorail component 66. A recessed surface 72, of slightly more than fifty percent of the width of monorail component 66, is fabricated back from each end 70 and shaped to form a circle with a diameter the same as the height of monorail component 66. Further, the circle center of recessed surface 72 is selected to be coincident with the semicircle center of end 70. The two recessed surfaces 72 are positioned on opposite sides of the monorail component 66. An edge 74 is formed between the end of recessed surface 72, remote from monorail end 70, which edge 74 vertically extends towards and connects to the side of monorail component 66. The pointed ends 76 of edge 74 may be cut back by an amount d, such as one fourth of an inch, from a line through the center and perpendicular to the top and bottom of monorail component 66. This avoids a dangerous sharp edge on the monorail component and allows two monorail components 66 to be coupled together at an angle, as shown in FIG. 12, without the pointed edges of the edge 74 interfering with one another.

A connection pad 78, of a material, such as the described in U.S. Pat. Nos. 3,270,408, 4,216,257, 4,290,174, 4,290,832 and 4,322,875 is placed in each of the recessed surfaces 72. This type of material, known as Scotchmate Dual Lock Fasteners, manufactured by the 3M Company of Saint Paul, Minn., is such that when it is placed adjacent to a similar piece of the same material and compression is applied, a firm connection results. Alternatively, any similar compressively connecting material, such as Velcro or certain types of adhesives, may be used in place of pads 78. The shape of pad 78 may be circular and may have a slightly smaller diameter than the diameter of the recessed surface 72 circle. The thickness of connection pad 78 and the amount of the recess of recessed surface 72 should be such that when two monorail components 66 are connected together, the sides of the two components 66 are aligned on the same plane.

Referring now to FIGS. 11 and 12, the manner of connecting the monorail components 66 together is now described. The two facing sides of connecting pad are placed together with the end of each monorail component 66 placed against the edge 74 of the other monorail component. Then a compressive force is applied and the two monorail components 66 are secured together with the sides, top and bottom of each monorail component 66 aligned in the same plane. Because the ends 76 are cut back by amount d, two monorail components 66 may be connected together at an angle, as shown in FIG. 12. The amount of the distance d determines the amount of the angle at which the two monorail components may be coupled. This angle should be approximately 150°, or greater, in order to allow the vehicle 30 to properly slide over the curved surface so formed. When curved monorail components 66 are used, such as shown in FIGS. 9 and 10, the curve may be directed in either direction by selectively connecting either one or the other end of the monorail component 66 to the other monorail component 66. Thus, right or left curves can be formed using the same component shown in FIG. 10 or rising or falling curves can be formed by using the same component shown in FIG. 9.

Referring now to FIGS. 13A through 13D, a stanchion 80 is shown which is useful in holding monorail component 66 above the floor or in supporting monorail component 66 as it is connected to fixed monorail 26 in a direction towards the floor. The top of stanchion 80 includes a dome shape 82 having a notch 84 positioned in one direction through dome 82. The size of notch 84 is selected to allow a monorail component 66 to securely fit therein and be supported thereby. The bottom of stanchion 80 has a circular cutout 86 therein of a size to allow dome 82 to fit therein for stacking. Thus, several stanchions 80 may be used to maintain the monorail component any desired height above the floor.

It should be noted that the entire assembly is made of wood, which may be covered by an appropriate nontoxic wood preservative. Such a preservative may be selected to also constitute the smoothing additive referred to above.

What is claimed is:

1. A track member having a rectangular cross section and a given length bounded by two ends, said member having a pair of relatively longer sides and a narrower top and bottom, said member forming a monorail track which can be attached to a similar monorail track, the improvement comprising:

said member ends being formed in a semicircular shape with a diameter equal to the length between said top and bottom;

first and second recessed surfaces, each positioned on an opposite side and end of said member, each of said recessed surfaces extending from said top to said bottom of said member and back from the end of said member, each recessed surface terminating with a back in the shape of a circular arc of less than 180° and having a diameter equal to the length between said top and bottom, said back extending from said recessed surface to said side of said member; and attachment means affixed to each of said recessed surfaces within the circle formed by said member ends and recessed surface back, said attachment means being of a type to be compressively attached to a corresponding attachment means affixed on another member to form an affixation therebetween.

2. The invention according to claim 1 wherein said arc is terminated along a line remote from the arc center in a direction opposite to said end, said terminating line being perpendicular to the top and bottom of said member.

3. The invention according to claim 2 wherein the center of said arc is positioned coincident with the center of said end.

4. The invention according to claim 3 wherein said recessed surface is recessed more than one half of the distance between said sides.

5. The invention according to claim 4 wherein said attachment means is circular and affixed with the center thereof coincident with the center of the semicircle of said end.

6. The invention according to claim 1 wherein said recessed surface is recessed more than one half of the distance between said sides.

7. The invention according to claim 1 wherein said attachment means is circular and affixed with the center thereof coincident with the center of the semicircle of said end.

8. A track vehicle set container building and component comprising:

a curved floor above the bottom of said building and having a permanently affixed vehicle track thereon;

an plurality of openings through said building, two of which are aligned with said permanently affixed track and a third of which is below said floor;

a plurality of fixed and removable panels forming a closed volume above said floor and below said floor on both sides of said third opening for storing assemblable parts to said set, said parts being attached from one side of said permanently affixed track to the other side of said permanently affixed track and including sufficient parts to provide a track path through said third opening;

a vehicle; and engageable lock means, selectively affixing said vehicle to said permanently affixed track when engaged therebetween and allowing said vehicle to travel over a path defined by said assembled parts when disengaged;

wherein said track is a monorail track and has a rectangular cross section and a given length bounded by two ends, said track having a pair of relatively longer sides and a narrower top and bottom, said track forming a monorail track which can be attached to a similar monorail track, said track further including track ends formed in a semicircular shape with a diameter equal to the length between said top and bottom; first and second recessed surfaces, each positioned on an opposite side and end of said track, each of said recessed surfaces extending from said top to said bottom of said track and back from the end of said track, each recessed surface terminating with a back in the shape of a circular arc of less than 180° and having a diameter equal to the length between said top and bottom, said back extending from said recessed surface to said side of said track; and attachment means affixed to each of said recessed surfaces within the circle formed by said track ends and recessed surface back, said attachment means being of a type to be compressively attached to a corresponding attachment means affixed on another track to form an affixation therebetween.

9. The invention according to claim 8:

wherein said track is a monorail track; and wherein said vehicle has a cutout in the bottom thereof wider than the width of said given width and a pair of members extending from the body of said vehicle into said cutout, each of said extension members having a hard material flat surface of substantially said given width and coplanar with the corresponding flat, smooth surface of the other of said extension members and at least one of said monorail surface or said flat surfaces of said extension members having a smoothing additive placed thereon to permit said flat surfaces of said vehicle to easily slide over said flat surface of said monorail.

* * * * *